US011548015B2

(12) United States Patent
Parisi-Amon et al.

(10) Patent No.: US 11,548,015 B2
(45) Date of Patent: Jan. 10, 2023

(54) SHOWERHEAD FOR CONSISTENT SHOWER EXPERIENCES OVER A RANGE OF INLET PRESSURES

(71) Applicant: Nebia Inc., San Francisco, CA (US)

(72) Inventors: Gabriel Parisi-Amon, San Francisco, CA (US); David Shulman, San Francisco, CA (US); Jad Nasrallah, San Francisco, CA (US); Brian Willkom, San Francisco, CA (US); Thomas E. Murphy, San Francisco, CA (US)

(73) Assignee: Nebia Inc., San Francisco, CA (US)

( * ) Notice: Subject to any disclaimer, the term of this patent is extended or adjusted under 35 U.S.C. 154(b) by 681 days.

(21) Appl. No.: 16/566,777

(22) Filed: Sep. 10, 2019

(65) Prior Publication Data

US 2020/0086334 A1 Mar. 19, 2020

Related U.S. Application Data

(63) Continuation-in-part of application No. 16/541,069, filed on Aug. 14, 2019, now abandoned, which is a (Continued)

(51) Int. Cl.

*B05B 1/18* (2006.01)
*B05B 1/12* (2006.01)

(Continued)

(52) U.S. Cl.

CPC ..... *B05B 1/185* (2013.01); *B05B 1/12* (2013.01); *B05B 1/16* (2013.01); *B05B 1/169* (2013.01);

(Continued)

(58) Field of Classification Search

CPC .... B05B 1/04; B05B 1/06; B05B 1/12; B05B 1/16; B05B 1/169; B05B 12/085;

(Continued)

(56) References Cited

U.S. PATENT DOCUMENTS 3,836,083 A * 9/1974 Bell ..... E03C 1/08 239/572
4,082,225 A * 4/1978 Haynes ..... E03C 1/084 239/533.1

(Continued)

*Primary Examiner* — Darren W Gorman

(74) *Attorney, Agent, or Firm* — Run8 Patent Group, LLC; Peter Miller; Leah Raddatz

(57) ABSTRACT

One variation of a system includes: a mount defining an inlet configured to couple to a water supply; a body defining a fluid circuit and coupled to the mount; and a pressure regulator interposed between the inlet and the fluid circuit and configured to regulate water supplied at the inlet over a range of inlet pressures to a range of internal pressures less than and narrower than the range of inlet pressures. A set of nozzles arranged on the body and coupled to the fluid circuit are configured to, in response to the pressure regulator regulating a first inlet pressure down to a first internal pressure, discharge water droplets: exiting the body with kinetic energies in a range of kinetic energies; exiting the body in a first spray pattern defining a first width at a target distance below the body, and exhibiting a first volumetric ratio of water to air.

20 Claims, 6 Drawing Sheets

Related U.S. Application Data continuation of application No. 15/895,913, filed on Feb. 13, 2018, now Pat. No. 10,421,083, which is a continuation of application No. 15/273,684, filed on Sep. 22, 2016, now Pat. No. 9,931,651, which is a continuation-in-part of application No. 14/814,721, filed on Jul. 31, 2015, now Pat. No. 9,925,545.

(60) Provisional application No. 62/043,095, filed on Aug. 28, 2014, provisional application No. 62/729,349, filed on Sep. 10, 2018.

(51) Int. Cl.
*B05B 1/16* (2006.01)
*B05B 1/06* (2006.01)
*B05B 1/04* (2006.01)

(52) U.S. Cl.
CPC ..... *B05B 1/18* (2013.01); *B05B 1/04* (2013.01); *B05B 1/06* (2013.01)

(58) Field of Classification Search
CPC ..... B05B 12/087; B05B 12/088; B05B 1/18; B05B 1/185; E03C 1/0408
See application file for complete search history.

(56) References Cited

U.S. PATENT DOCUMENTS 4,202,501 A * 5/1980 Haynes ..... B05B 1/3006 239/553.3
4,244,526 A * 1/1981 Arth ..... B05B 15/654 239/533.1
4,275,843 A * 6/1981 Moen ..... B05B 1/323 239/570
5,143,300 A * 9/1992 Cutler ..... B05B 1/3026 239/562
5,294,054 A * 3/1994 Benedict ..... B05B 1/3006 239/383
2012/0138839 A1* 6/2012 Fangmeier ..... G05D 7/016 251/356
2014/0106296 A1* 4/2014 Woodard ..... A61C 15/00 433/80

* cited by examiner

| SHOWER ASPECT | ACTION | OTHER ASPECTS AFFECTED |
|---|---|---|
| Increase warmth | Increase nozzle flow rates | • Water savings reduced |
| Increase warmth | Decrease nozzle spray angle | • Droplet sensation: increased potential for stinging sensation<br>• Body coverage reduced |
| Increase hair rinsing efficacy | Increase nozzle flow rates | • Water savings reduced |
| Increase hair rinsing efficacy | Decrease nozzle spray angle | • Droplet sensation: - i increased potential for stinging sensation<br>• Body coverage reduced |
| Increase lower body rinsing efficacy | Increase shower flow rate | • Water savings reduced |
| Increase width of cloud of droplets at target distance | Increase nozzle spray angle | • Reduced rinsing efficiency<br>• Reduced body temperature |
| Decrease water consumption | Increase number of nozzles and decrease flow rate per nozzle | • Reduced body temperature<br>• Reduced rinsing efficiency |
| Decrease stinging sensation | Increase nozzle orifice sizes and decrease operating pressure | • Body temperature increased<br>• Rinsing efficiency decreased |

*FIG. 8*

SHOWERHEAD FOR CONSISTENT SHOWER EXPERIENCES OVER A RANGE OF INLET PRESSURES

CROSS-REFERENCE TO RELATED APPLICATIONS

This application claims the benefit of U.S. Provisional Application No. 62/729,349, filed on 10 Sep. 2018, which is incorporated in its entirety by this reference.

This application is a continuation-in-part application of U.S. patent application Ser. No. 16/541,069, filed on 14 Aug. 2019, which is a continuation of U.S. patent application Ser. No. 15/895,913, filed on 13 Feb. 2018, which is a continuation of Ser. No. 15/273,684, filed on 22 Sep. 2016, which is a continuation-in-part application of U.S. patent application Ser. No. 14/814,721, filed on 31 Jul. 2015, which claims the benefit of U.S. Provisional Application No. 62/043,095, filed on 28 Aug. 2014, each of which is incorporated in its entirety by this reference.

TECHNICAL FIELD

This invention relates generally to the field of plumbing and more specifically to a new and useful showerhead for consistent shower experiences over a range of inlet pressures in the field of plumbing.

BRIEF DESCRIPTION OF THE FIGURES

FIG. 8 is a graphical representation of one variation of the system.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. System

Figure 1A:
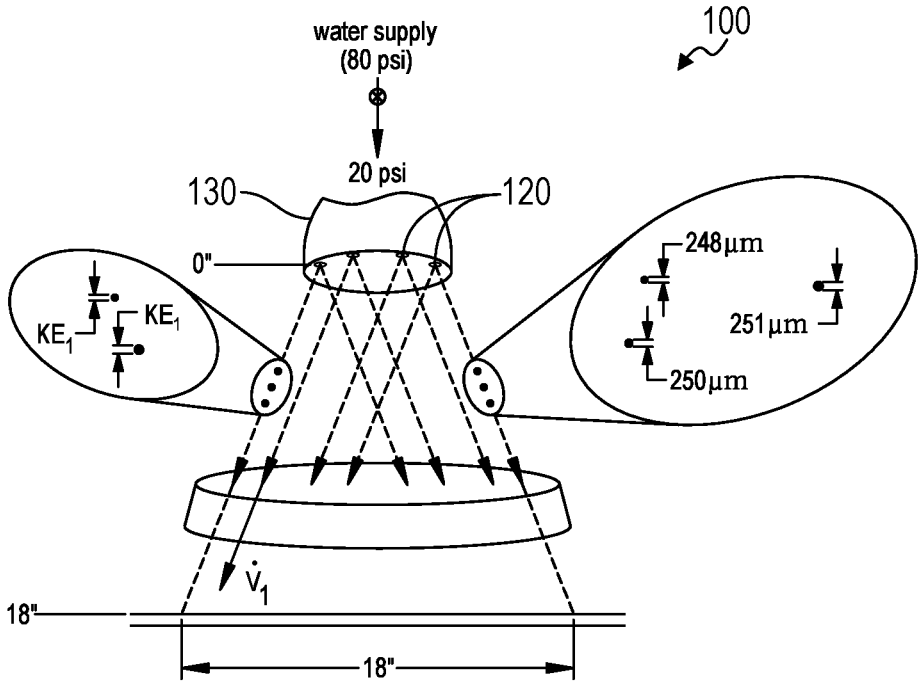
FIGS. 1A and 1B are schematic representations of a system.
Figure 1B:
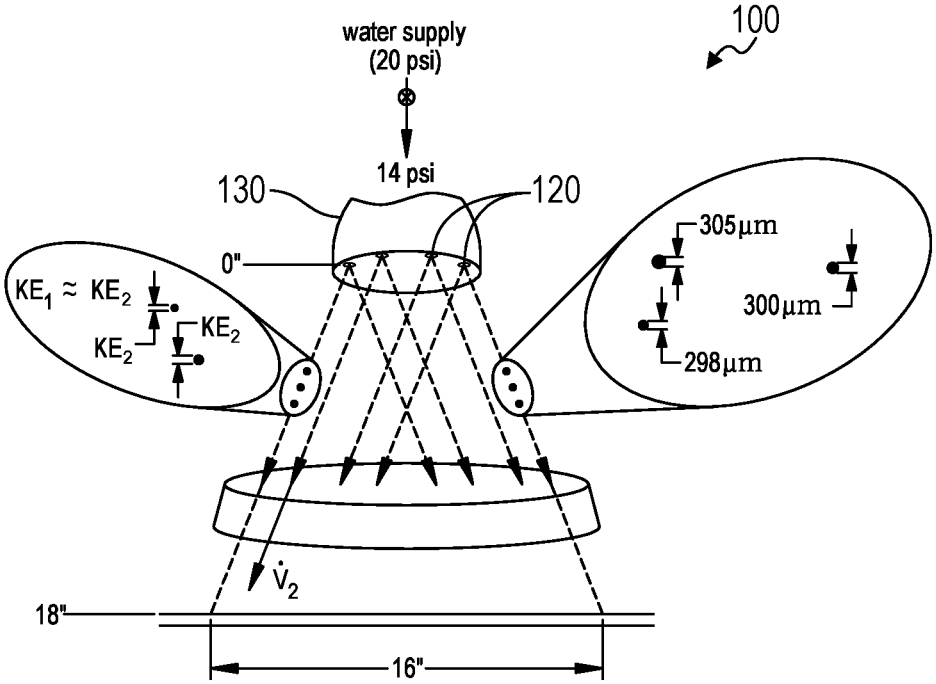
Figure 2:
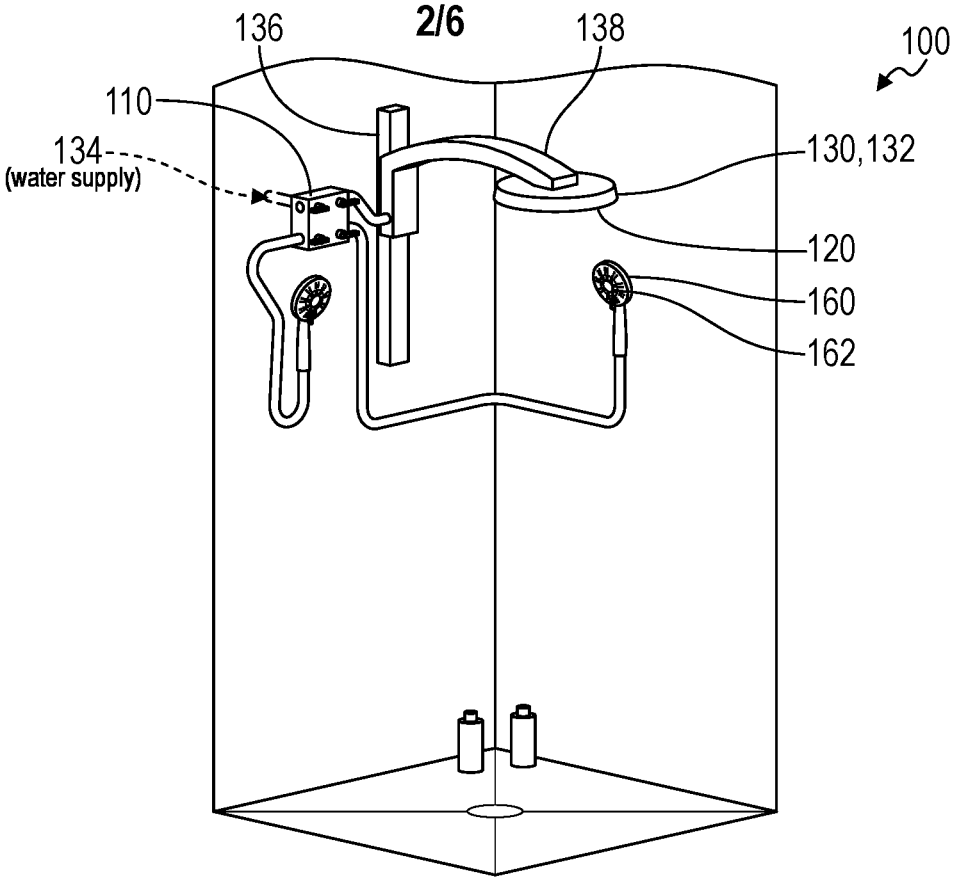
FIG. 2 is a schematic representation of a showerhead.

As shown in FIGS. 1A and 1B and FIG. 2, a system 100 includes: a mount 136 comprising a proximal end defining an inlet 134 configured to couple to a water supply; a body 130 defining a fluid circuit 132 and coupled to the mount 136; and a pressure regulator 110 interposed between the inlet 134 and the fluid circuit 132 and configured to regulate a water supply at the inlet 134 over a range of inlet pressures to a range of internal pressures in the fluid circuit 132, the range of internal pressures less than and narrower than the range of inlet pressures. In response to the pressure regulator 110 regulating water supplied at a first inlet pressure at the inlet 134 down to a first internal pressure in the fluid circuit 132. The system 100 also includes a set of nozzles 120 arranged on the body 130 and coupled to the fluid circuit 132, the set of nozzles 120 configured to discharge water droplets that exit the body 130 with kinetic energies in a first range of kinetic energies and that form a first spray pattern that extends from the body 130, defines a first width at a target distance below the body 130, and exhibits a first volumetric ratio of water to air. In response to the pressure regulator 110 regulating water supplied at a second inlet pressure less than the first inlet pressure at the inlet 134 down to a second internal pressure less than the first internal pressure in the fluid circuit 132, the set of nozzles 120 is further configured to discharge water droplets exiting the body 130 with kinetic energies in a second range of kinetic energies approximating the first range of kinetic energies and forming a second spray pattern that extends from the body 130 approximating the first spray pattern, defines a second width approximating the first width at the target distance below the body 130, and exhibits a second volumetric ratio of water to air approximating the first volumetric ratio.

In one variation, the system 100 includes: a mount 136 including a proximal end defining an inlet 134 configured to couple to a water supply; a body 130 defining a fluid circuit 132; a set of nozzles 120 arranged on the body 130 and coupled to the fluid circuit 132; and a pressure regulator 110 interposed between the inlet 134 and the fluid circuit 132. The pressure regulator 110 is configured to regulate a water supply at the inlet 134 over a range of inlet pressures to a range of internal pressures less than and narrower than the range of inlet pressures. In response to supply of water at a first inlet pressure in the range of inlet pressures at the inlet 134: the pressure regulator 110 regulates the supply of water down to a first internal pressure, in the range of internal pressure; and the set of nozzles 120 discharges water droplets a) exiting the body 130 at a first exit velocity, b) exhibiting a first size range, and c) in a first spray pattern extending from the body 130, defining a first width at a target distance below the body 130, and exhibiting a first volumetric ratio of water to air. In response to supply of water at a second inlet pressure in the range of inlet pressures and less than the first inlet pressure at the inlet 134: the pressure regulator 110 regulates the supply of water down to a first internal pressure, in the range of internal pressures; and the set of nozzles 120 discharges water droplets a) exiting the body 130 at a second exit velocity less than the first exit velocity, b) exhibiting a second size range greater than the first size range, and c) in a second spray pattern extending from the body 130 approximating the first spray pattern, defining a second width approximating the first width at the target distance below the body 130, and exhibiting a second volumetric ratio of water to air approximating the first volumetric ratio.

1.1 Applications

Generally, the system 100 includes a pressure regulator 110 and a set of nozzles 120 that cooperate to discharge water droplets in a target spray pattern—within a bathing environment—exhibiting narrow, controlled ranges of droplet inertia (or "energy"), droplet heat loss, volumetric flux (i.e., volume flow across a unit area), and spray geometry over a range of distances from the set of nozzles 120 despite a wide range of possible water supply pressures at the bathing environment. In particular, the system 100 includes a set of nozzles 120—fluidly coupled to an upstream pressure regulator 110—that output a cloud of water droplets in a target spray pattern that balances rinsing efficacy (e.g., as a function of droplet kinetic energy and volumetric flux), warmth (e.g., user perception of droplet temperature near her torso as a function of droplet heat loss and volumetric flux), and droplet sensation (e.g., delicate rather than stinging as a function of droplet inertia) in order to achieve a consistent shower experience for a user substantially regardless of water pressure supplied to the system 100.

The pressure regulator 110 can regulate a water supply—which may fall within a wide range of 20 pounds per square inch (hereinafter "psi") to 80 psi in more than 95% of showers in the United States of America—down to a narrow range of internal pressures (e.g., between 14 psi and 20 psi). The set of nozzles 120 can define orifice geometries and can be arranged in a pattern within a showerhead that yields substantially consistent droplet kinetic energy, droplet heat loss, volumetric flux, and spray geometry over a range of distances from the set of nozzles 120 substantially regardless of water supply pressure (e.g., within a range of water supply pressures between 20 psi and 80 psi). Therefore, the pressure regulator 110 and the set of nozzles 120 can cooperate to yield a consistent experience (such as given consistent inlet temperatures) in a variety of bathing environments, such as: in showers in both the first floor and top floor of a high-rise building (i.e., high and low water supply pressures, respectively); in new construction with new plumbing and in old construction with clogged pipes; in buildings with and without water pressure boosters; and in buildings with well-supplied water and in buildings with water supplied by a municipality or water department; etc.

The set of nozzles 120 is configured to cooperate with the pressure regulator 110 to discharge water droplets sufficiently small (e.g., less than 500 micrometers in width) such that water droplets exhibit a greater hang time than larger water droplets generated by typical showerheads in order to yield a relatively high volumetric ratio of water droplets to air within a cloud of water droplets while operating at lower flow rates than typical showerheads.

In one implementation, the pressure regulator 110 and the set of nozzles 120 is incorporated into a showerhead to regulate a water supply of unknown or variable pressure (hereinafter "inlet pressure") to within a narrow range of lower internal pressures in order to achieve a consistent shower experience for a user. In particular, the pressure regulator 110 and the set of nozzles 120 cooperate to discharge water droplets within a narrow range of sizes and speeds and in a target spray pattern to form a droplet cloud that: achieves a relatively long hang time (i.e., a time that these droplets remain in the air before reaching the bottom of a shower pan); achieves a degree of heat retention sufficient to provide a sense of warmth at a user's torso; achieve kinetic energies that avoid "stinging" sensations upon impact with a user's skin; and achieves a high volumetric ratio of water droplets to air within a greater discharged cloud or "curtain" of droplets around a user. Such characteristics of the cloud of water droplets discharged by the set of nozzles 120 may translate into a "pleasant" shower experience for a user, including yielding perceptions of "warmth," "softness," "fullness" (e.g., a high volumetric ratio of water to air near the user's torso), and "wetness" while enabling efficient rinsing during a shower and despite a wide range of possible inlet pressures and inlet pressure variance.

1.2 Example

In one implementation, the system 100 includes: a mount 136 defining a proximal end configured to couple to a water supply; a body 130 of maximum width less than eight inches, defining a fluid circuit 132, and coupled to the mount 136 to form a showerhead; a pressure regulator 110 interposed between the inlet 134 and the fluid circuit 132 and configured to regulate a water supply at the inlet 134 over a range of inlet pressures approximately (e.g., within 10%) between 20 psi and 80 psi down to a lesser and narrower range of internal pressures approximately between 14 psi and 20 psi; and a set of six full cone nozzles 120 arranged on the body 130 in a circular pattern of radius less than four inches and coupled to the fluid circuit 132. The set of six full cone nozzles 120 can be configured to cooperate with the pressure regulator 110 to discharge water droplets: predominately between 130 micrometers and 430 micrometers in width (e.g., more than 90% of droplets exhibiting widths in this range); at flow rates between 0.8 gallons-per-minute and 1.5 gallons-per-minute; and in a first spray pattern extending from the body 130, defining a first width of at least 12 inches at a target distance below the body 130, and exhibiting a high volumetric ratio of water to air (e.g., greater than 5%, that is significantly greater than 100% relative humidity generated by a showerhead with jets or aerator). In particular, because the volumetric ratio of water to air dispensed by the set of nozzles 120 is high in the vicinity of the user's head and torso, the user may perceive this cloud of droplets as "full," "immersive," and/or "enveloping."

For example, in this implementation, the pressure regulator 110 can regulate a water supply at the inlet 134 at a first inlet pressure of 80 psi down to a first internal pressure of 20 psi. The set of nozzles 120 can then cooperate with the pressure regulator 110 to discharge water droplets: exhibiting an average width of 250 micrometers; at a flow rate of 1.35 gallons-per-minute; in a first conical spray pattern at a first spray angle proportional to the first internal pressure; and that form a first droplet cloud of approximately a target width (e.g., 18 inches) at a distance of 18 inches from the body 130.

In this example, the pressure regulator 110 can similarly regulate a water supply at a second inlet pressure of 20 psi at the inlet 134 down to a second internal pressure of 14 psi. The set of nozzles 120 can then cooperate with the pressure regulator 110 to discharge water droplets: exhibiting an average width of 300 micrometers; at a flow rate of approximately 1.05 gallons-per-minute; in a second conical spray pattern at a second spray angle proportional to the second internal pressure; and that form a second droplet cloud of approximately the target width at a distance of 18 inches from the body 130. In these examples, for an inlet pressure of 80 psi, the set of nozzles 120 can discharge droplets that form a droplet cloud approximately 18 inches wide (i.e., less than 20 inches wide) at a distance of 18 inches from the body 130; for an inlet pressure of 20 psi, the set of nozzles 120 can discharge droplets that form a droplet cloud approximately 17 inches wide (i.e., more than 16 inches wide) at a distance of 18 inches from the body 130.

1.3 Shower Experience

The system 100 can discharge droplets within a narrow range of exit velocities and exhibiting sizes within a narrow range of droplet sizes to achieve: a target rinsing efficacy; a user perception of warmth; target body coverage; and a gentle sensation of droplets, as shown in FIG. 8.

For example, for a higher inlet pressure (e.g., 80 psi), the pressure regulator 110 outputs an internal pressure at an upper bound of the narrow range of internal pressures; accordingly, the set of nozzles 120 discharge smaller droplets at a higher flow rate and at higher exit velocities. These droplets form a droplet cloud of width near an upper bound of a target width range (e.g., 18" wide at 18" below the head) such that a user bathing under the system 100 perceives that she is fully bathed in water. Because these droplets are relatively small, these droplets may individually exhibit lower heat retention. However, this cloud of smaller droplets may also exhibit longer hang time than a cloud of larger droplets and may thus achieve greater heat retention en masse, thereby producing a sensation of warmth for the user.

Additionally, in response to the pressure regulator regulating a higher inlet pressure down to an internal pressure at an upper bound of the narrow range of internal pressures, the showerhead discharges relatively smaller droplets at relatively higher flowrates, which may counteract the lower heat retention of the smaller droplets and thus maintain a sensation of warmth for the user.

Conversely, for a lower inlet pressure (e.g., 20 psi), the pressure regulator 110 outputs an internal pressure at a lower bound of the narrow range of internal pressures. Accordingly, the set of nozzles 120 discharges larger water droplets at a lower flow rate and at lower exit velocities. These droplets may form a droplet cloud of approximately the target width such that the user bathing under the system 100 again perceives that she is fully bathed in water and experiences a sensation of "wetness". These droplets form a droplet cloud of width near a lower bound of the target width range (e.g., 16" wide at 18" below the head) such that a user bathing under the system 100 similarly perceives that she is fully bathed in water. Though flow rate through the system may be lower at lower inlet pressures, these droplets discharged by the system 100 are relatively large and may thus exhibit greater heat retention, thereby producing a sensation of warmth for the user.

Furthermore, in the foregoing example, in response to the pressure regulator 110 regulating a high inlet pressure (e.g., 80 psi) down to a high internal pressure (e.g., 20 psi), the set of nozzles 120 can discharge water droplets exiting the body 130 at approximately a first exit velocity (e.g., within 5% of) and approximately exhibiting (e.g., within 10% of) a first size. In response to the pressure regulator 110 regulating a second inlet pressure less than the first inlet pressure down to a second internal pressure less than the first inlet pressure, the set of nozzles 120 can discharge water droplets exiting at approximately a second exit velocity less than the first exit velocity and approximately exhibiting a second size greater than the first size. Therefore, the total kinetic energies of droplet clouds output by the set of nozzles 120 at the upper and lower bounds of the range inlet pressures may be similar and less than a droplet kinetic energy typically associated with transition of human dermal sensation from gentle impact of water droplets to stinging impact of water droplets.

The combination of the lower flow rate, larger droplets, and slower droplets discharged by the system 100 at the low inlet pressure may thus yield a similar—and sufficient—rinsing efficacy as the higher flow rate, smaller droplets, and faster droplets discharged by the system 100 at the high inlet pressure. Therefore, the pressure regulator 110 and the set of nozzles 120 can cooperate to achieve similar rinsing efficacies across this wide range of possible inlet pressures.

Thus, the system 100 can fluidly couple to a water supply of unknown or variable pressure (or "inlet pressure") and regulate this water supply at unknown inlet pressure down to an internal pressure within a target internal pressure range and then discharge water droplets in a droplet cloud that approximates a target spray pattern, kinetic energy, heat retention, and flow rate that consistently yields a target shower experience for a user despite unknown or variable pressure of the water supply. The system 100 can thus yield sufficient rinsing efficacy, sufficient perception of warmth for a user (e.g., minimum temperature of droplets upon impact with a human body), sufficient body coverage (e.g., minimum width of a droplet cloud at distances from the showerhead), and sufficient droplet sensation (e.g., gentle droplet impact on skin of a user) for a user at relatively low flow rate and despite unknown or variable pressure of the water supply.

1.4 Shower Experience Control

Generally, by regulating water supplied at an unknown inlet pressure down to a narrow range of internal pressures and by discharging water regulated down to this narrow range of internal pressures through a set of nozzles, the system 100 can isolate droplet sensation (e.g., droplet softness versus droplet "stinginess") from other droplet characteristics (e.g., flow rate, spray pattern, temperature). More specifically, with the narrow range of internal pressures, the set of nozzles 120 may discharge droplets in similar spray patterns, at similar flow rates, and with similar temperature loss over a distance (e.g., 20 inches) from the body 130. However, droplet size may increase and droplet exit velocity may decrease with lower internal pressures—and therefore lower inlet pressures—and vice versa. Therefore, a user may manipulate a set of external shower controls to vary inlet pressure at the inlet 134—such as from a lower bound of 20 psi to a maximum water pressure in the user's shower stall—in order to predominantly modify the sensation of droplets discharged from the system 100 while minimally effecting other rinsing efficacy, flow rate, spray pattern, and/or other droplet characteristics.

For example, a user may open shower controls to start a shower. Once the shower controls are opened by a minimum threshold to yield an inlet pressure of 20 psi at the inlet 134, these shower controls may be substantially decoupled from water flow rate, rinsing efficacy, and spray pattern output by the system 100. At this minimum threshold, the system 100 discharges largest water droplets of slowest velocity. As the user further opens the shower control, the inlet pressure at the inlet 134 may increase, and the system 100 discharges smaller water droplets of greater velocity. In one example, if the nozzles discharge droplets of size and velocity that vary linearly and inversely as a function of internal pressure, the average kinetic energy of droplets discharged by the system 100 as the user opens the shower controls may increase, thereby increasing a possibility that the user experiences a "stinging" sensation from these discharged droplets. Accordingly, the user may adjust the shower controls to achieve her preferences for "softness" and "stinginess" of her shower. Therefore, the system 100 enables a user a user to finely adjust the sensation of droplets by adjusting the supply pressure of water with the shower controls, and the system 100 transforms the external shower control from a flow controller that varies volume flow rate into a droplet sensation control that varies droplet kinetic energy while maintaining substantially constant volume flow rate through the system.

2. Variation

Figure 4:
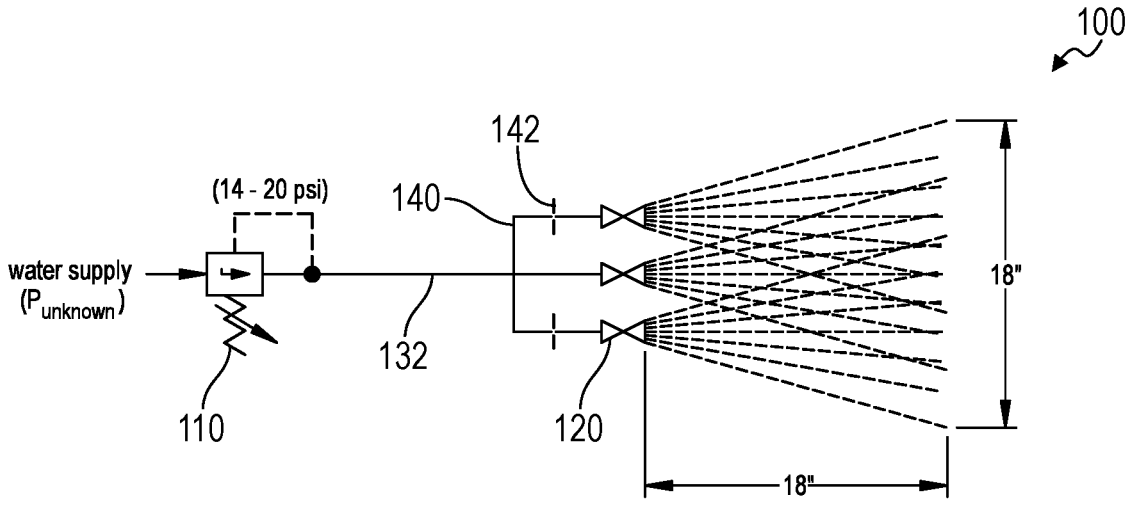
FIG. 4 is a schematic representation of one variation of the showerhead.

As shown in FIG. 4, one variation of the system 100 includes: a pressure regulator 110 configured to regulate a water supply of unknown and variable pressure down to a target pressure; a manifold 140 fluidly coupled to an outlet of the pressure regulator 110; a set of nozzles 120 fluidly coupled to the manifold 140 and configured to discharge water droplets; and a set of flow restrictors 142 interposed between the pressure regulator 110 and select nozzles in the set of nozzles 120 to match sizes, speeds, and distributions of water droplets discharged from the set of nozzles 120 to a target shower experience based on an outlet pressure of the pressure regulator 110.

2.1 Applications

Generally, in this variation, the showerhead includes a combination of an upstream pressure regulator 110, downstream nozzles, and flow restrictors 142 arranged between the pressure regulator 110 and nozzles, all of which cooperate to discharge water droplets within a narrow range of target sizes (e.g., diameters) and within a narrow range of target speeds within a greater curtain or droplet cloud of a particular target geometry matched to a particular bathing, washing, or rinsing experience (e.g., a particular feeling of "wetness" and warmth) while limiting water consumption. The pressure regulator 110, downstream nozzles, and flow restrictors 142 are described herein as incorporated into a showerhead and cooperate to regulate a water supply of unknown pressure and variance over time down to target inlet pressures at nozzles. Accordingly, the set of nozzles 120 discharge water droplets of sizes and speeds that extend hang time, achieve a degree of heat retention sufficient to provide a sense of warmth before passing a user's torso, achieve kinetic energies that avoid "stinging" sensations upon impact with a user's skin, and achieve a high volumetric ratio of water droplets to air within a greater discharged cloud or "curtain" of droplets around a user, all of which may translate into sensations of "warmth," "softness," and "wetness" while maintain enabling efficient rinsing during a shower. In this example, by further focusing the curtain or droplet cloud to a limited volume that encompasses a portion of a human user's body (e.g., the user's head and torso up to a width of 14" for a user standing under the showerhead), the pressure regulator 110, downstream nozzles 120, and flow restrictors 142 can cooperate to minimize water consumption without substantively impacting the user's showering experience.

Generally, a typical showerhead with jets or an aerator configured to output large drops of water (e.g., greater than one millimeter in diameter) or continuous streams of water may yield an experience (e.g., senses of warmth and wetness) that improves with greater supply pressure and greater volume flow rate (while diminishing a sensation of softness) and therefore greater water consumption. However, a showerhead including a set of nozzles 120 configured to output smaller droplets of water (e.g., 130 microns to 430 microns) may discharge a curtain or droplet cloud exhibiting peak sensations of warmth and of wetness—without substantially reducing a sensation of softness—at a lower regulated pressure and lower flow rate (e.g., 1.0 gallon per minute rather than, for example, 2.5 gallons per minute for a jetted showerhead). Unlike a jetted showerhead, increased inlet pressure and flow rate may reduce droplet size, increase droplet speed, and increase spray angles of the set of nozzles 120, all of which may reduce a sensation of warmth and reduce a sensation of softness while increasing water consumption and without substantively increasing a sensation of wetness (e.g., since large spray angles resulting from the increased flow rate may increase the size of the curtain or droplet cloud discharged by the set of nozzles 120 but not substantively increase the volumetric ratio of droplets to air within the shower).

Therefore, the showerhead can include a pressure regulator 110 that cooperates with downstream flow restrictors 142 to achieve target inlet pressures across the set of nozzles 120, which thus yields target droplet sizes, target droplet speeds, and a target geometry of a greater curtain or droplet cloud discharged from this set of nozzles 120 despite the pressure (e.g., temperature and variations thereof) of a water supply. In particular, the pressure regulator 110, downstream flow restrictors 142, and nozzles can be matched to achieve a consistent, quality shower experience (e.g., high perception of warmth, softness, rinsability, and wetness) for a user showering under the showerhead while limiting water consumption and airborne moisture outside of the curtain or droplet cloud despite a water supply of unknown and possible varying pressure (and temperature, etc.).

However, the pressure regulator 110, downstream flow restrictors 142, and nozzles can be integrated into a kitchen faucet, a bathroom faucet, or other fluid dispenser to similarly achieve better, more controlled experiences for a user and with less water consumption.

3. Pressure Block+Nozzles

The pressure regulator 110 is configured to regulate a water supply—such as a tap into a water main—down to a maximum pressure matched to downstream nozzle types, nozzle arrangement, and flow restrictor arrangement within the showerhead. In particular, the pressure regulator 110 can be coupled to a water supply of unknown—and possibly varying—pressure (e.g., between 25 psi and 80 psi) and can output water a pressure that is the lesser of: the pressure of the water supply; and a target water pressure matched to the nozzle and flow restrictor configuration of the showerhead to achieve a particular shower experience for a user.

Generally, a typical showerhead with jets or an aerator regulates water flow via a flow rate regulator, specifically monitoring flowrates. Alternatively, the pressure regulator 110 is configured to regulate water pressure, monitoring inlet pressures and regulating an inlet pressure down to an internal pressure.

The pressure regulator 110 can be: interposed between an inlet 134 configured to couple to a water supply and a fluid circuit 132; and configured to regulate a water supply at the inlet 134 over a range of inlet pressures to a range of internal pressures in the fluid circuit 132, the range of internal pressures less than and narrower than the range of inlet pressures.

In one variation, the pressure regulator 110 can be configured to regulate a water supply at the inlet 134 over a range of inlet pressures between 20 psi and 80 psi to a range of internal pressures predominately between 14 psi and 20 psi (i.e., with 90% of internal pressures in this range) in the fluid circuit 132. For example, the pressure regulator 110 can be configured to: regulate water supplied at a first inlet pressure of 80 psi down to a first internal pressure of 20 psi in the fluid circuit 132; and regulate water supplied at a second inlet pressure of 20 psi down to a second internal pressure of 14 psi in the fluid circuit 132. Therefore, the pressure regulator 110 can regulate water supplied at a wide range of inlet pressures down to a narrower and lower range of internal pressures to cooperate with a set of nozzles 120 downstream and thus achieve a particular shower experience for a user.

The set of nozzles 120 can be arranged on a body 130 defining the fluid circuit 132 and can be configured to: in response to the pressure regulator 110 regulating water supplied at a first inlet pressure at the inlet 134 down to a first internal pressure in the fluid circuit 132, discharge water droplets exiting the body 130 with kinetic energies in a first range of kinetic energies (e.g., between 0.118 microjoules and 2.40 microjoules), and in a first spray pattern extending from the body 130, defining a first width at a target distance below the body 130, and exhibiting a first volumetric ratio of water to air; and, in response to the pressure regulator 110 regulating water supplied at a second inlet pressure less than the first inlet pressure at the inlet 134 down to a second internal pressure less than the first internal pressure in the fluid circuit 132, discharge water droplets exiting the body 130 with kinetic energies in a second range of kinetic energies approximating the first range of kinetic energies, and in a second spray pattern extending from the body 130 approximating the first spray pattern, defining a second width approximating the first width at the target distance below the body 130, and exhibiting a second volumetric ratio of water to air approximating the first volumetric ratio.

3.1 Maximum Droplet Size

In particular, the pressure regulator 110 can be configured to regulate a water supply down to a pressure matched to configurations of nozzles within the showerhead such that these nozzles discharge droplets within a target narrow range of sizes. Generally, a ratio of the rate of heat transfer and heat capacity of a volume of liquid may be inversely correlated to a size of the volume. More specifically, a smaller droplet may be characterized by a larger ratio of surface area to volume, which may yield faster equilibration of the droplet's temperature and an ambient temperature and therefore sensation of a "colder" droplet for a user.

Generally, a nozzle exposed to a higher pressure at its nozzle inlet 134 may discharge smaller droplets, which may therefore retain less mass-averaged thermal energy at greater distances from the nozzle and thus yield a colder shower (or washing) experience for a user. For example, jets common in showerheads or aerators in faucets may discharge large drops of water or continuous streams (or "jets") of water that exhibit relatively low ratios of surface area to volume and therefore retain more mass-averaged thermal energy between the jet or aerator and a terminal destination (e.g., a floor of a shower, a sink); such jets and aerators may also exhibit low sensitivity to pressure variations, and a user's bathing or washing experience may improve (e.g., greater senses of wetness and warmth) as pressure at the jet or aerator inlet 134 increases and as flow rate through the jet or aerator increases. However, the showerhead includes nozzles that may exhibit relatively high sensitivity to inlet pressure, wherein the average size of droplets discharged by the nozzle varies as a function of inlet pressure (e.g., inversely correlated to inlet pressure above a low inlet pressure). Therefore, the pressure regulator 110 can regulate the water supply to a target pressure that yields lower inlet pressures at the set of nozzles 120, thereby increasing sizes of droplets discharged by these nozzles, yielding an increased temperature of these droplets at greater distances from the showerhead, and increasing a sensation of "warmth" for a user showering under this showerhead.

In one variation, the pressure regulator 110 and the set of nozzles 120 cooperate to discharge water droplets predominately (e.g., greater than 90%) between 130 micrometers and 430 micrometers in width. (Alternatively, the pressure regulator 110 and the set of nozzles 120 cooperate to discharge water droplets with average widths between 130 micrometers and 430 micrometers in width.) For example, in response to the pressure regulator 110 regulating a first inlet pressure of 80 psi down to a first internal pressure of 20 psi at the fluid circuit 132, the set of nozzles 120 can discharge droplets of a first width of 250 micrometers and with a first thermal energy. In response to the pressure regulator 110 regulating a second inlet pressure of 20 psi down to second internal pressure of 14 psi at the fluid circuit 132, the set of nozzles 120 can discharge droplets of a second width of 300 micrometers and with a second thermal energy greater than the first thermal energy. Therefore, the pressure regulator 110 and the set of nozzles 120 can cooperate to discharge droplets within a narrow range of internal pressures to achieve a target droplet size within a range of sizes proportional to the thermal energy of the droplets.

3.2 Maximum Droplet Exit Speed

Similarly, the showerhead includes nozzles that may discharge droplets at velocities that vary proportional to the pressure at their nozzle inlets. Generally, greater nozzle inlet pressure may yield droplets that reach a terminal destination (e.g., the floor of the shower, a sink) in less time and therefore yield a lower volumetric ratio of water droplets to air between the nozzle outlet and the terminal destination at any instant in time. Conversely, a lower droplet velocity may yield increased "hang time" between ejection of the droplet from the nozzle outlet and arrival of the droplet at the terminal destination, such as due to air currents within the shower carrying or "upwelling" smaller droplets, as described below. In particular, greater hang time over many droplets ejected from the set of nozzles 120 in the showerhead over time may: yield a greater volumetric ratio of water to air between these nozzles and the terminal destination; wet an object (e.g., a user's body) in less time; yield a greater sensation of "wetness" for a human bathing or washing within the space between the set of nozzles 120 and the terminal destination; and displace cooler air out of this space with more heated droplets of water; and thus achieve greater heat retention and a sensation of higher temperature within this space.

Therefore, the pressure regulator 110 can regulate the water supply down to the target pressure that yields slower droplet exit speeds at the outlet of the nozzle.

3.3 Minimum Droplet Size

Conversely, smaller droplets may be carried upwardly (i.e., against the flow of droplets out of a nozzle and toward a terminal destination below) over greater distances, at greater frequencies, and/or over greater periods of time by air currents within the shower, such as occurring due to thermal gradients from the floor below the showerhead to the ceiling above the showerhead and/or due to a shower fan arranged in the ceiling. Thus, smaller droplets may exhibit greater hang time between ejection of the droplet from the nozzle outlet and arrival of the droplet at the terminal destination. Greater average droplet hang time may increase the average volumetric ratio of water droplets to air within a cloud or curtain of droplets—discharged by the showerhead—at any instant in time, which may yield a greater sensation of "wetness" for a user. However, small droplets exhibiting greater hang times may also move behind the curtain or droplet cloud at greater distances and/or greater frequency, thereby increasing humidity beyond the curtain or droplet cloud in the space occupied by the user under the showerhead, thereby reducing humidity control outside of the shower, increasing heat transfer from the user's skin to water vapor in the air outside of the shower when the user later exits the shower, and thus increasing the user's sensation of "cold" and discomfort when the user later exits the shower.

In one example, at an upper bound of droplet size, droplets discharged by nozzles in the showerhead may be too large for air currents within the shower (e.g., from a temperature gradient in the shower and from a shower fan drawing air upward) to impart an upward force on these droplets—moving downward from the showerhead—of sufficient magnitude to slow these droplets and thus substantively increase hang time for these larger droplets. Therefore, the pressure regulator 110 can regulate the water supply down to the lesser of a supply pressure and the target pressure that yields droplets small enough to be "upwelled" by air currents within the shower, thereby achieving greater hang times for these small droplets and thus achieving a droplet curtain or droplet cloud containing a higher volumetric ratio of water to air at any instant in time despite a lower total volume flow rate through the showerhead than a showerhead containing standard jets or an aerator.

More specifically, the pressure regulator 110 can regulate a water supply to a target pressure such that the set of nozzles 120 discharge droplets: of sizes large enough to exhibit a minimum heat retention; small enough and slow enough to be lifted by air currents within the shower; but not so small and/or so slow as to be carried well beyond a target geometry of the curtain or droplet cloud thus discharged by the showerhead.

3.4 Combined Droplet Exit Speed and Droplet Size

Similarly, increasingly smaller sizes and increasing speeds of droplets discharged from the set of nozzles 120 may, at some bound, yield a "stinging" sensation for a human bathing or washing under the nozzle. Therefore, the pressure regulator 110 can regulate the water supply down to a target pressure (or narrow pressure range) that yields nozzle inlet pressures that produce both larger droplet sizes and slower droplet exit speeds at the outlet of the nozzle and thus increase comfort for a user bathing or washing under the nozzle.

For example, the set of nozzles 120 can be configured to: discharge water droplets exiting the body 130 at a first exit velocity and exhibiting a first average size in response to the pressure regulator 110 regulating water supplied at a first inlet pressure at the inlet 134 down to a first internal pressure in the fluid circuit 132; and discharge water droplets exiting the body 130 at a second exit velocity less than the first exit velocity and exhibiting a second average size greater than the first average size in response to the pressure regulator 110 regulating water supplied at a second inlet pressure less than the first inlet pressure at the inlet 134 down to a second internal pressure less than the first internal pressure in the fluid circuit 132.

Similarly, the set of nozzles 120 is configured to: discharge water droplets exiting the body 130 with kinetic energies in a first range of kinetic energies in response to the pressure regulator 110 regulating water supplied at the first inlet pressure at the inlet 134 down to the first internal pressure in the fluid circuit 132; and discharge water droplets exiting the body 130 with kinetic energies in a second range of kinetic energies approximating the first range of kinetic energies in response to the pressure regulator 110 regulating water supplied at the second inlet pressure less than the first inlet pressure at the inlet 134 down to the second internal pressure less than the first internal pressure in the fluid circuit 132.

Therefore, the set of nozzles 120 and the pressure regulator 110 cooperate to discharge droplets that exhibit (average) kinetic energies within a narrow or target range of kinetic energies outside of kinetic energies that commonly yield "stinging" sensations for humans.

3.5 Nozzle Discharge Geometry

Figure 6:
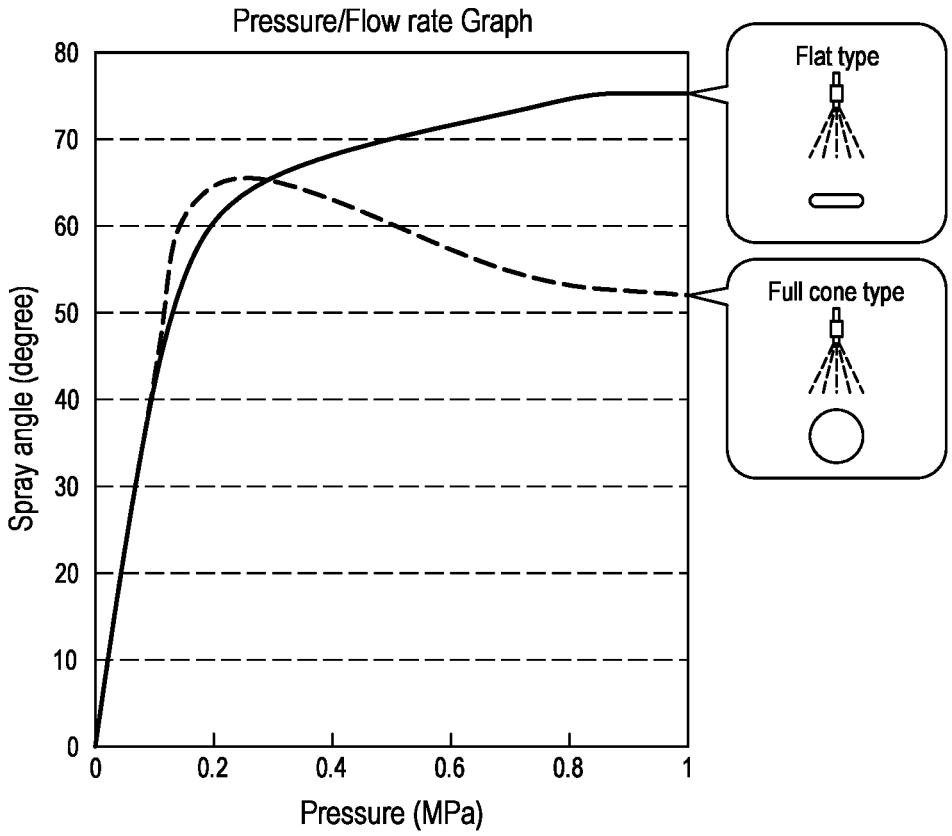
FIG. 6 is a graphical representation of one variation of the showerhead.

Furthermore, the showerhead can include flat fan, hollow cone, and/or full cone nozzles that output droplets at spray angles that change as a function of (e.g., directly proportional to) nozzle inlet pressure, as shown in FIG. 6. Therefore, the pressure regulator 110 can regulate the water supply down to the target pressure that is: sufficiently low to yield larger water droplets and slower droplet exit speeds, as described above; and sufficiently high to yield fans and cones of droplets—discharged from these nozzles—that exhibit spray angles that fall within a narrow target spray angle range.

Generally, the showerhead can be configured to discharge droplets of fluid downward toward a user's head and shoulders while the user bathes under the showerhead. In one implementation, the showerhead includes a set of nozzles 120 that cooperate to discharge droplets in the form of a curtain of a geometry that substantially encompasses the user's head and shoulders. Humans—including adults and children—exhibit head sizes and shoulder widths that fall within relatively narrow ranges (e.g., 6"+/−2" for widths of human heads, 16"+/−4" for widths of human shoulder). In order to discharge droplets in a curtain that envelops a user's head and most or all of the user's shoulders with nozzles arranged in a showerhead of a limited size (e.g., less than 10" in diameter), the showerhead can include a set of flat fan nozzles arranged in a circular pattern adjacent and tangent to the perimeter of the showerhead and angled relative to a primary axis of the showerhead such that flat fans of droplets discharged from these nozzles meet to form a curtain approximately 14" in diameter at a distance of 20" from the showerhead. In this implementation, the pressure regulator 110 can consistently regulate water supplied to these nozzles down to a target pressure such that these flat fan nozzles discharge water droplets at target spray angles to achieve this curtain geometry. In a similar implementation: the showerhead can include an array of full cone and/or hollow cone nozzles; and the pressure regulator 110 can consistently regulate water supplied to these nozzles down to a target pressure such that these flat fan nozzles discharge water droplets at target spray angles that together yield a droplet cloud approximately 20" wide and 14" deep at a distance of 20" from the showerhead.

Therefore, in these implementations, the pressure regulator 110 can regulate a water supply—which may be supplied at a wide, inconsistent, and varying range of pressures, such as from 25 psi to 80 psi, and vary by as much as 50% responsive to other water use in the same structure—down to a consistent target pressure that yields droplet discharges at consistent target spray angles from nozzles in the showerhead. By thus achieving consistent droplet discharge from these nozzles, these droplets may form a droplet curtain or droplet cloud of a consistent geometry matched to a common or average shape and size of humans, thereby achieving a consistent experience for a user during one shower with the showerhead, across multiple showers with the showerhead, and across multiple different units of the showerhead despite changes in water supply pressure at a showerhead over time or differences in water supply across various showerhead installations. Furthermore, by thus regulating the supply pressure down to the target pressure to yield droplets of a particular size and exit speed within a curtain or cloud of a particular geometry, the showerhead can also both a) achieve a pleasant bathing experience for a user who is thus enveloped in this curtain or cloud and b) minimize water waste, since the showerhead discharges little or no water droplets outside of this curtain or cloud and since droplets inside this curtain either contact the user before reaching their terminal destination or shield other droplets closer to the user from cooler air outside of the curtain or cloud, thereby maintaining an elevated temperature inside the curtain or cloud.

(In one variation in which the pressure regulator 110, the set of nozzles 120, and the flow restrictors 142 are integrated into a kitchen faucet configured to discharge droplets of fluid downward toward a soiled dish while a user cleans or rinses the dish in a sink, the faucet can include a set of nozzles 120 that cooperate to discharge droplets in the form of a fan or curtain: spanning a portion of the width of the dish (e.g., a 6"-wide fan at a distance of 8" from a head of the faucet); and containing droplets of a particular size, speed, and density sufficient to break food particles from the surface of the dish. Therefore, in order to achieve this target fan or curtain geometry with droplet sizes, speeds, and densities that enable rapid removal of food from a dish with reduced water consumption (i.e., "fast" and "efficient" rinsing) in a faucet containing nozzles characterized by relatively low flow rate and relatively small droplet size—despite unknown water pressures and water pressure variations in a building in which the faucet is installed—the faucet can include the pressure regulator 110 configured to output water at a target pressure matched to geometries of the set of nozzles 120 integrated into the faucet.)

3.6 Nozzle Arrangement

In one implementation, the set of nozzles 120 includes nozzles arranged in a circular pattern about the body 130. For example, the body 130 can define an eight-inch-diameter cylindrical section, and the set of nozzles 120 can include six nozzles arranged in a circular pattern—of radius less than four inches—centered about one side of the body 130. In this example, the set of nozzles 120 can discharge water droplets in conical sprays extending outwardly from the body 130 and at conical angles proportional to internal pressure. In particular, the set of nozzles 120 can: discharge a droplet cloud exhibiting minimum width greater than sixteen inches at a distance of eighteen inches below the body 130 in response to the pressure regulator 110 regulating an a first inlet pressure of 80 psi down to first internal pressure of 20 psi; and discharge a droplet cloud exhibiting maximum width less than twenty inches at the distance of eighteen inches below the body 130 in response to the pressure regulator 110 regulating a second inlet pressure of 20 psi down to a second internal pressure of 14 psi. Thus, in this implementation, the system 100 can define a showerhead of relatively small width and that produces a cloud of relatively consistent width—approximating the average width of adult human shoulders at a nominal distance below the body 130—substantially regardless of inlet pressure, such that most water discharged by the system 100 toward a user below engulfs the user; and such that little water discharged by the system 100 is projected far from the user's body and thus wasted.

4. Manifold and Flow Regulation

Therefore, the showerhead can include a pressure regulator 110 that functions to regulate a water supply to a target pressure (or to the lesser of the supply pressure and the target pressure) that is matched to types, geometries, and a distribution of nozzles within the showerhead in order to discharge droplets of a target size and at a target discharge speed within a greater curtain or cloud of a target geometry despite an unknown and possibly varying water supply pressure. The showerhead can further include a manifold 140 configured to distribute fluid from the outlet of the pressure regulator 110 to individual nozzles or to groups of nozzles, such as in described in U.S. patent application Ser. No. 15/895,913.

Figure 3:
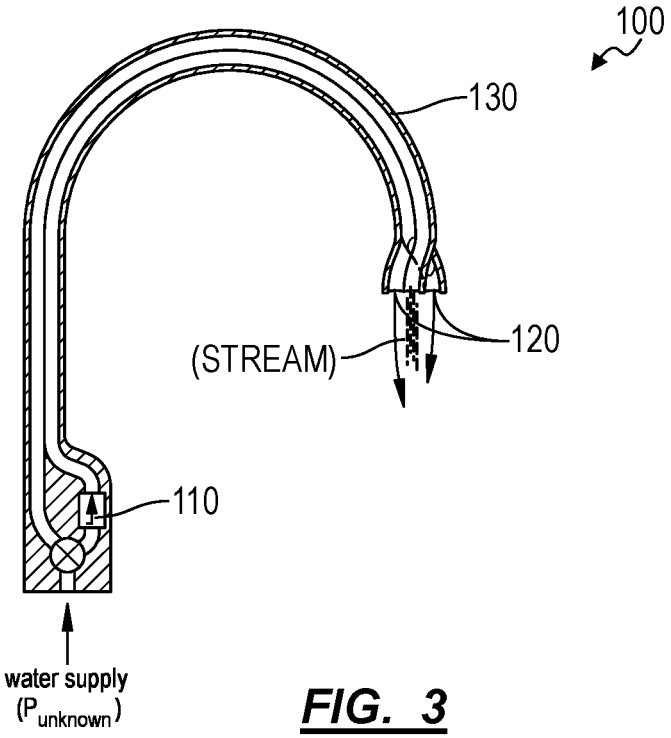
FIG. 3 is a schematic representation of a faucet.

However, the showerhead can include nozzles of different types (e.g., flat fan, hollow cone, and/or full cone) configured to discharge droplets of different target sizes and/or at different target speeds to form sprays of different geometries, as shown in FIGS. 3 and 4. Therefore, the showerhead can include flow restrictors 142 (e.g., orifice plates) interposed between the pressure regulator 110 and the set of nozzles 120 in order to further reduce pressure at the inlets of these nozzles. In particular, once the pressure regulator 110 regulates water flowing into the manifold 140 down to a substantially constant target pressure from a substantially unlimited source (e.g., a water main within a building), a flow restrictor—arranged within the manifold 140 or along branches of the manifold 140 fluidly coupled to individual or groups of nozzles within the showerhead—can further reduce water pressure and flow to this individual nozzle or group of nozzles, thereby: increasing droplet size; reducing droplet speed; and/or reducing spray angle for droplets discharged from these nozzles.

In one example, the pressure regulator 110 is configured to regulate a water supply down to a target pressure equivalent to a sum of: a target inlet pressure for a particular nozzle, in the showerhead, designated for a greatest inlet pressure; and head loss between the pressure regulator 110 and the particular nozzle under operating conditions. In this example, the showerhead can thus further include orifice plates interposed between the pressure regulator 110 and each other nozzle in the showerhead in order to reduce inlet pressures at each of these nozzles to corresponding nozzle-specific target inlet pressures given the known, regulated outlet pressure of the pressure regulator 110.

Therefore, the showerhead can include both the pressure regulator 110 and downstream flow restrictors 142 that cooperate to achieve a consistent, target inlet pressure at each nozzle in the showerhead and thus achieve a target distribution of droplet sizes and speeds within a greater target curtain or cloud geometry.

5. Showerhead: Nozzle Array

In the variation described above in which the pressure regulator 110, the set of nozzles 120, and the flow restrictors 142 are integrated into a showerhead, the set of nozzles 120 can include flat fan, full cone, and/or hollow cone nozzles, as described in U.S. patent application Ser. Nos. 14/814,721 and 15/895,913. In this variation, the pressure regulator 110 can regulate a commercial or residential water supply—which may vary from an average of 20 psi to an average of 80 psi and vary by as much as 50% over time (e.g., responsive to other water use in the same structure—down to a target pressure of 25 psi). In this example, the showerhead can also: include orifices of a first size between the pressure regulator 110 and a set of flat fan nozzles arranged about a perimeter of the showerhead in order to reduce the spray angle of these flat fan nozzles; include orifices of a second, smaller size between the pressure regulator 110 and a set of hollow cone nozzles in order to reduce the size of droplets discharged by these hollow cone nozzles; and omit a flow restrictor between the pressure regulator 110 and a central full cone nozzle in order to maximize a spray angle and total volume flow rate through the central full cone nozzle given the output pressure of the pressure regulator 110.

In one variation, the showerhead includes a set of 6 full cone nozzles arranged in a circular pattern of maximum radius less than four inches about the body 130.

However, the showerhead can include any number, type, and configuration of nozzles and can include any other configuration of flow restrictors 142—matched to the target pressure output by the pressure regulator 110—in order to achieve a dispersion of droplets of a target size, speed, and distribution despite the average pressure or variations in pressure of the water supply.

6. Showerhead: Mount

Figure 7:
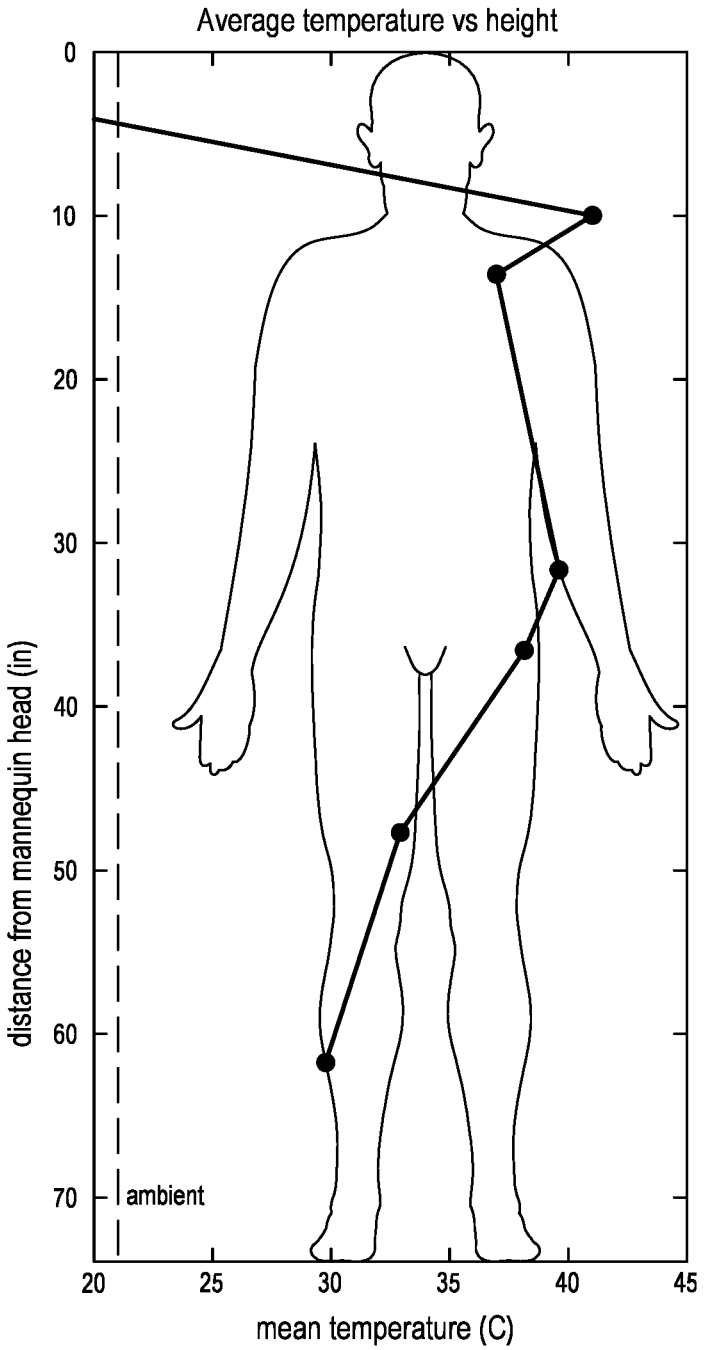
FIG. 7 is a graphical representation of one variation of the system.

In the foregoing variation, the showerhead can be arranged on a mount 136: configured to support the showerhead over a range of vertical positions; and adjustable by manually lifting the showerhead (or the mount 136) upward or drawing the showerhead (or the mount 136) downward. In particular, the showerhead can discharge a curtain or droplet cloud of a geometry configured to envelop a user's head and shoulders; and the temperature of this curtain or droplet cloud may decrease with distance from the showerhead—as shown in FIG. 7. Therefore, the showerhead can be arranged on an adjustable mount 136 that enables a user to—quickly, with a single hand, and without tools—raise or lower the showerhead to a position over the user's head (e.g., 4-8 inches over the user's head) such that the curtain or droplet cloud envelops the user's head and shoulders and such that this curtain or droplet cloud exhibits a temperature that is comfortable for the user.

As described in U.S. patent application Ser. No. 15/673,310, the mount 136 can include: a wall element configured to fixedly couple to a wall, such as to a drop ear within a shower stall; an arm 138 coupled to and configured to translate vertically along the wall element and defining a distal end coupled to and supporting the showerhead; and a spring element configured to impart a vertical force upward from the wall element to the arm 138 in order to counter the weight of the arm, the showerhead, and water contained within the showerhead and plumbing between the wall element and the showerhead.

Alternatively, the mount 136 can include: a ferrous (e.g., steel) wall element configured to fixedly couple to a wall of a shower stall; an arm 138 coupled to and configured to translate vertically along the wall element and defining a distal end coupled to and supporting the showerhead; and a magnetic element arranged in the arm, configured to magnetically couple to the wall element, and configured to retain the arm 138 against the wall element and permit the arm 138 to slip along the wall element when a user manually manipulates the showerhead or the arm, as shown in FIG. 2.

However, the mount 136 can include any other elements or features to enable a user to easily, manually raise and lower the showerhead within a shower stall.

6.1 Showerhead: Fluid Pathway and Port Block

In the foregoing variation the pressure regulator 110 can be arranged remotely from the showerhead. For example, the pressure regulator 110 can be integrated into the wall mount 136 and located proximal the drop ear in the shower stall when the wall mount 136, arm, and showerhead are installed.

Alternatively, the pressure regulator 110 can be arranged in a port block separate and discrete from the wall element, and the port block can define one or more outlet ports fluidly coupled to the outlet of the pressure regulator 110, as shown in FIG. 2. In this implementation: the wall mount 136 can be mounted to a wall of the shower separately from the drop ear, such as with an adhesive, tape, or mechanical fastener; and the port block can be mounted to, near, or otherwise fluidly coupled to the drop ear and separate from the wall mount 136. In these implementations: a rigid or flexible water line—arranged internal or external the wall mount 136 and the arm 138—can distribute a pressure-regulated supply of water from the pressure regulator 110 (e.g., from an outlet port of the port block) to an inlet 134 port on the showerhead; and a manifold 140 within the showerhead can distribute pressure-regulated water from the inlet 134 port to the set of nozzles 120.

Yet alternatively: the pressure regulator 110 can be integrated into a body 130 of the showerhead (e.g., adjacent the inlet 134 port of the showerhead); a rigid or flexible water line can distribute an unregulated supply of water from the drop ear to the pressure regulator 110 within the showerhead; and a manifold 140 within the showerhead can distribute pressure-regulated water from the pressure regulator 110 to the set of nozzles 120.

7. Wand

In one variation described in U.S. patent application Ser. No. 15/673,310 and shown in FIG. 2, the showerhead is paired with a separate wand 160 that includes a second set of nozzles 162.

In one example, the second set of nozzles 162 can be fluidly coupled to the same pressure regulator 110 as the showerhead and configured to discharge water droplets with an average kinetic energy less than droplets discharged by nozzles of the showerhead. In this example, the system 100 can include: a showerhead defining a first set of nozzles 120; and a wand 160 defining a second set of nozzles 162 configured to fluidly couple to the pressure regulator 110. In response to the pressure regulator 110 regulating water supplied at a first inlet pressure at the inlet 134 down to a first internal pressure: the first set of nozzles 120 can discharge water droplets exiting the body 130 with kinetic energies in a first range of kinetic energies and in a first spray pattern extending from the body 130, defining a first width at a target distance from the showerhead, and exhibiting a first volumetric ratio of water to air; and the second set of nozzles 162 can discharge water droplets exiting the wand with kinetic energies in a third range of kinetic energies greater than the first range of kinetic energies and in a third spray pattern extending from the wand, defining a third width less than the first width at the target distance from the wand 160, and exhibiting a third volumetric ratio of water to air less than the first volumetric ratio of water to air. Therefore, in this example, water droplets discharged by the wand 160 can exhibit higher average kinetic energy than droplets discharged by the showerhead. The wand 160 can be manipulated by a user in a bathing environment to selectively rinse more specific regions of her body. For example, the second set of nozzles 162 in the wand 160 can be configured to discharge larger water droplets at higher exit velocities in order to achieve higher kinetic energies thus increase rinsing efficacy when the wand 160 is manipulated by a user to rinse soap from a particular region of her body.

In one implementation, the wand 160: includes a hose configured to tap into a pressure-regulated output of the pressure regulator 110; and is configured to pivotably and transiently couple to a wand mount installed on a wall of a shower stall. For example, the wand mount can include a magnetic element arranged inside of a body defining a convex or concave surface. In this example, a body of the wand 160 can be fabricated (e.g., stamped) from sheet steel to define a concave or convex surface configured to mate with the like surface of the wand mount and can magnetically couple to the magnetic element within the wand mount to retain the wand 160 on the wand mount when not held by a user. In a similar example: the wand mount can be stamped, formed, or drawn from a sheet of a ferrous material; and a magnetic element can be arranged inside the wand body and configured to magnetically couple to the ferrous body of the wand mount, thereby retaining the wand 160 on the wand mount.

In the implementation described above in which the showerhead includes a port block, the pressure regulator 110 can be integrated into the port block, and the port block can define a set of pressure-regulated outlet ports, each fluidly coupled to the outlet of the pressure regulator 110. Each outlet port can also include a quick-connect fitting, such as a self-sealing quick-connect female fitting. To connect the wand 160 to the port block, a user may thus insert a quick-connect fitting (e.g., a quick-connect male fitting) on the end of the hose of the wand 160 into an outlet port of the port block, which may then supply pressure-regulated water to the second set of nozzles 162 in the wand 160.

Alternatively, in the implementation described above in which the pressure regulator 110 is integrated into the wall mount 136, a wand 160 port can be arranged in the wall mount 136 and can tap into an outlet of the pressure regulator 110. The wand 160 can thus be fluidly coupled to the pressure-regulated output of the pressure regulator 110 by connecting the hose of the wand 160 to the wand 160 port on the wall mount 136.

In this variation, the wand 160 can include a valve: operable in a closed position to block fluid flow from the hose to the second set of nozzles 162 in the wand 160; and operable in an open position to pass fluid from the hose to the second set of nozzles 162. (The showerhead or arm 138 can similarly include a valve configured to selectively enable or disable fluid flow to all or a subset of nozzles 120 in the showerhead.) Alternately, the port block can include one actuatable valve interposed between the pressure regulator 110 and an outlet port for each outlet port in the port block, as shown in FIG. 2; and a user may thus selectively open or close a valve at an output port coupled to the hose of the wand 160 in order to enable or disable flow through the wand 160. (The user may similarly selectively open or close a valve at an output port coupled to the hose of the showerhead in order to enable or disable flow through all or a subset of nozzles 120 in the showerhead.)

8. Modular Assembly

In one variation shown in FIG. 2, the showerhead is a component in a kit of elements that includes: a port block containing the pressure regulator 110 and multiple (e.g., three or more) outlet ports fluidly coupled to the pressure regulator 110, as described above; a set (i.e., one or more) of showerheads, such as coupled to fixed or adjustable mounts 136, as described above; and a set of wands 160 paired with wand mounts configured to transiently and adjustably couple to and support the set of wands.

In this variation, a user may acquire the port block and one showerhead, install the port block in-line with a drop ear in her home shower, attach the wall mount 136 and the showerhead to the wall of the shower stall, and connect the showerhead to the first outlet port of the port block with a flexible hose. Later, the user may acquire a wand 160 and wand mount, attach the wand mount to a wall in her shower stall, and connect the hose of the wand 160 to the second outlet port of the port block. Over time, the user may develop a preference for the wand 160 over the showerhead and therefore: acquire a second wand 160 and second wand mount and a third wand 160 and third wand mount; remove the showerhead from the shower stall and port block; attach the second and third wand mounts to the wall at different positions within her shower stall (e.g., with the first, second, and third wand mounts arranged at height of the user's face, upper torso, and lower torso within the shower stall); and connect the hoses of the second and third wands to the first and third outlet ports of the port block. The port block can thus supply pressure-regulated water to each of these three wands 160. Later, the user can reinstall the showerhead in the shower stall and can reconnect the showerhead to a fourth port on the port block and/or move the wand mounts to different walls and/or different heights within the shower stall to achieve a different, personalized shower experience.

9. Nozzle Manufacture

The showerhead can include a lower body 130 section and an upper body 130 section that are assembled (e.g., bonded, heat-staked, welded) to form the manifold 140 (i.e., a fluid pathway) extending from an inlet 134 port fluidly coupled to the pressure regulator 110 to the set of nozzles 120 as shown in FIG. 4. In one implementation, the lower body 130 section of the showerhead defines a set of discrete nozzle ports at target locations of nozzles (e.g., at the end of each leg of the manifold 140), such as described in U.S. patent application Ser. No. 15/895,913. In this implementation, each nozzle can define a complete nozzle element configured to be threaded, clamped, bonded, or otherwise fastened to a corresponding nozzle port in the lower body 130 section of the showerhead. For example, the lower body 130 section of the showerhead can define a set of threaded nozzle ports fluidly coupled to the manifold 140. In this example, a user may: select from a set of discrete nozzles of different types and exhibiting different droplet sizes and discharge speeds as a function of nozzle inlet pressure; and install these discrete nozzles in threaded nozzle ports in the lower body 130 section, thereby personalizing the showerhead. In this example, the manifold 140 inside the showerhead can be configured to yield substantially uniform head loss between the inlet 134 port and each threaded bore, and each discrete nozzle can include an integrated flow restrictor configured to reduce pressure into the nozzle inlet 134 in order to match size, speed, and distribution of droplets discharged from the nozzle to a known pressure within the manifold 140 during typical operation.

Figure 5:
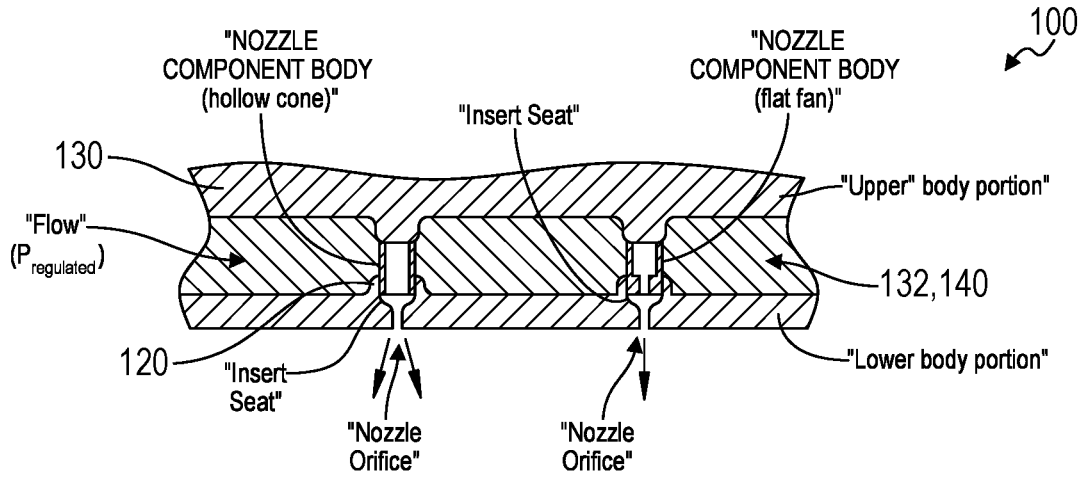
FIG. 5 is a schematic representation of one variation of the showerhead.

Alternatively, the lower body 130 section can define a nozzle orifice at each nozzle location (e.g., at the end of each leg of the manifold 140), and the lower and upper body 130 sections can be configured to receive a nozzle component insert at each nozzle orifice location in order to complete each nozzle, as shown in FIG. 5. In this implementation, each nozzle component insert can define a geometry configured to yield a corresponding spray geometry—as shown in FIG. 4—such as: a swirl chamber insert for a full cone nozzle; and a swirl plate for a hollow cone nozzle. For example: each nozzle component insert can define a cylindrical body 130; the lower body 130 section can define a cylindrical counterbore centered over each nozzle orifice; and the upper body 130 section can define a tongue (or similar feature) aligned with the counterbore in the lower body 130 section and configured to depress and retain a nozzle component insert into the adjacent counterbore when the upper body 130 section is assembled over the lower body 130 section. Additionally or alternatively, a nozzle component insert can be bonded, welded, or threaded into a bore, insert seat, or other feature over a corresponding nozzle orifice in the lower body 130 section. Therefore, the lower body 130 section can define the nozzle orifice of a full or hollow cone nozzle in the showerhead, and the showerhead can include a nozzle component insert that cooperates with the nozzle orifice to complete a nozzle. Furthermore, in this implementation, a flat fan nozzle can be manufactured (e.g., formed, molded) directly into the lower body 130 section of the showerhead, such as with a semi-spherical or paraboloid feature formed on the interior-side of the lower body 130 section and a v-notched feature formed on the exterior-side of the lower body 130.

In the foregoing implementation, the lower body 130 section (and the upper body 130 section) can be manufactured with a nozzle orifice in situ. For example, the lower body 130 section—including manifold features, nozzle component insert bores or seats, and nozzle orifices—can be injection molded in a polymer (e.g., a thermoset or thermoform plastic) in a single operation; the lower body 130 section can then be trimmed, nozzle component inserts can be located (and bonded) over their corresponding seats, and the upper body 130 section (which may be similarly injection molded) can be assembled over the lower body 130 section (e.g., by welding, bonding, or heat-staking). Alternatively, the lower body 130 section can be injection molded with nozzle orifice features and then post machined (e.g., in a CNC drilling or milling machine) to drill or machine nozzle orifices through the nozzle orifice features before the nozzle component inserts are loaded onto their seats and the upper body 130 section installed. In these implementations, a nozzle component insert can be injection molded, machined, or otherwise manufactured. By thus separating manufacture of the nozzle orifices from the nozzle component inserts, the showerhead may be completed with tight relative locational tolerances across the array of nozzle orifices; while also enabling production of the nozzle component inserts—which may be dimensionally much smaller than the lower body 130 section—with very tight tolerances, which may thus enable both tight control over droplet sizes, speeds, and spray patterns from these completed nozzles and reduce manufacture and assembly costs for the showerhead.

In one implementation in which the showerhead includes both flat fan nozzles and hollow and/or full cone nozzles, the lower body 130 section of the showerhead can: define nozzle orifices and a nozzle component insert seat at each hollow and/or full cone position; and define a nozzle seat configured to receive a complete nozzle at each flat fan position. Therefore, in this implementation, the lower body 130 section: can define nozzle orifices and locate nozzle component inserts at some nozzle positions; and can receive separate, complete (e.g., threaded) nozzles at other nozzle positions, such as at positions of nozzles defining primary axes non-normal to an injection-molding parting axis of the lower body 130 section.

However, the lower body 130 section can define a set of nozzle features and/or can be configured to receive separate, complete nozzles in any other way. Furthermore, the showerhead can include one or multiple body 130 sections manufactured and assembled in similar or other ways and in any other material to form a manifold 140 configured to fluidly couple an inlet 134 port (or the pressure regulator 110 directly) to a set of nozzles 120. The wand 160 can be similarly configured and manufactured with discrete or integrated nozzles.

10. Variation: Faucet

In one variation shown in FIGS. 3 and 4, the pressure regulator 110, set of nozzles 120, and flow restrictors 142 are integrated into a faucet, such as a kitchen faucet or a bathroom faucet.

10.1 Kitchen Faucet

In one implementation in which the pressure regulator 110, set of nozzles 120, and flow restrictors 142 are integrated into a kitchen faucet, the kitchen faucet can include: an inlet 134 configured to fluidly couple to a water supply (e.g., a water main at a kitchen sink), such as via integrated or separated hot and cold valves; an unregulated fluid pathway fluidly coupled to the inlet 134; a regulated fluid pathway fluidly coupled to the inlet 134; a valve between the unregulated and regulated fluid pathways; and a faucet body 130 defining the inlet 134 and a distal end opposite the inlet 134. In this implementation, the unregulated fluid pathway can include a rigid or flexible fluid supply line extending from the valve to an open-bore outlet at the distal end of the faucet body 130. (The kitchen faucet can also include an aerator across the open-bore outlet.) Similarly, the regulated fluid pathway can include: the pressure regulator 110 coupled to the valve; a rigid or flexible fluid supply line extending from the pressure regulator 110 to a manifold 140 near the distal end of the faucet body 130; and the set of nozzles 120 fluidly coupled to the manifold 140 and arranged adjacent (e.g., around, circumferentially about) the open-bore outlet at the distal end of the faucet body 130, as shown in FIG. 3.

For example, the set of nozzles 120 can include a set of (e.g., two, three) flat fan nozzles arranged about the distal end of the faucet body 130 with their secondary axes parallel to one another. In this example, the primary axes of the flat fan nozzles can be angled toward one another such that the sheets of droplets discharged by the flat fan nozzles meet and cross at some distance (e.g., 6") from the distal end of the faucet body 130 to form a high-energy (e.g., high-velocity, high-temperature) spray pattern focused to a long, narrow line at this intersection, which may quickly break and remove food from a dish while limiting consumption of water at the kitchen faucet during this rinse process. In particular, in this example, the pressure regulator 110, the manifold 140, and the set of valves can be matched to achieve a particular discharge geometry tailored to high-efficiency removal of food waste from dishes, such as including large droplets (e.g., 300 microns in average diameter) moving at high speed and forming a narrow spray (e.g., ¼" in width) spanning a target length corresponding to a common dish size at a common working distance of the distal end of the faucet to a dish (e.g., a target fan length of 6" at a distance of 8" from an average dinner and salad dish 9" in diameter).

Thus, when the valve is in a first position that opens the unregulated fluid pathway and closes the regulated fluid pathway, the valve can direct water—at an unregulated pressure—through the open-bore outlet with minimal restrictions, thereby maximizing volume flow rate through the faucet body 130. A user may therefore set the valve in the first position to quickly fill a pot with water from this kitchen faucet. However, when the valve is in a second position that closes the unregulated fluid pathway and opens the regulated fluid pathway, the valve can direct water into the pressure regulator 110, which regulates the water supply down to a target pressure, as described above. The manifold 140 directs this pressure-regulated water to the set of nozzles 120, which discharge droplets from the distal end of the faucet body 130. As in the foregoing example, a user may therefore set the valve in the second position when rinsing a dish in order to increase rate of food removal while reducing water consumption.

In this implementation, the regulated fluid pathway in the kitchen faucet can include: a second manifold 140 arranged near the distal end of the faucet body 130; a second set of nozzles 162 fluidly coupled to the second manifold 140 and arranged near the first set of nozzles 120; a second rigid or flexible fluid supply line fluidly coupled to the second manifold 140; and a second valve interposed between the outlet of the pressure regulator 110 and the fluid supply lines coupled to the first and second sets of nozzles. In this implementation, the second set of nozzles 162 can include a set of hollow cone or full cone nozzles, and flow restrictors 142 arranged within the second manifold 140 can be matched to these nozzles and the pressure regulator 110 in order to achieve droplets of moderate size exhibiting lower discharge speeds, greater dwell time, and wider spray angles than the set of flat fan nozzles for rinsing, which may produce a soft droplet cloud characterized by a low total volume flow rate and a high volumetric ratio of water droplets to air within the sink, thereby enabling a user to efficiently wet and wash her hands.

In the foregoing implementation, the first and second valves can be physically coupled and thus operable in synchronized positions, including: a first position in which the first valve directs water into the unregulated fluid pathway; a second position in which the first valve directs water into the unregulated fluid pathway and the second valve directs water toward the first set of nozzles 120 (e.g., the set of flat fan nozzles); and a third position in which the first valve directs water into the unregulated fluid pathway and the second valve directs water toward the second set of nozzles 162 (e.g., the set of hollow or full cone nozzles). Therefore, a user may: set the valves in the first position when filling a pot; set the valves in the second position when rinsing a dish; and set the valves in the third position when washing her hands. Furthermore, in this implementation, the kitchen faucet can default to setting the valves in the third position in order to minimize water consumption when the kitchen faucet is first actuated (e.g., when a hot or cold valve is opened). (Alternatively, the first and second valves can be integrated into one multi-stage valve defining multiple valve positions and flow paths.)

10.2 Bathroom Faucet

In a similar implementation, the pressure regulator 110, set of nozzles 120, and flow restrictors 142 are integrated into a bathroom faucet, such as including: a similar unregulated fluid pathway to enable a user to quickly fill a sink when shaving or hand-washing a garment; a first regulated fluid pathway including a first set of flat fan (or other) nozzles configured to discharge a sheet of higher-speed droplets, such as to enable a user to quickly rinse toothpaste from a toothbrush or soap from her hands; and a second regulated fluid pathway including a second set of nozzles 162 (e.g., hollow or full cone nozzles) configured to discharge a cloud or curtain of lower-speed droplets, such as to enable the user to quickly wet her hands when lathering with soap.

In one example, the bathroom faucet includes: a controller; a sensor; and a set of electromechanical valves, including a primary inlet 134 valve, a second valve coupled to the outlet of the primary inlet 134 valve and interposed between the first fluid pathway and the pressure regulator 110, and a third valve coupled to the outlet of the pressure regulator 110 and interposed between the second and third fluid pathways. The controller can actuate the electromechanical valves when the sensor detects a user's hands nearby. For example, when the controller detects presence of an object near the bathroom faucet via the sensor, the controller can: actuate the primary, first, and second valves to pass pressure-regulated water to the second set of valves for a first duration of time (e.g., 5 seconds) to form a soft cloud of slow, large water droplets that enable a user to quickly wet her hands; trigger the primary valve to close for a second duration of time (e.g., three seconds) while the user retrieves a dose of soap (or while a soap dispenser in the bathroom faucet dispenses a dose of soap); trigger the primary valve to open for a third duration of time (e.g., 15 seconds) to form a soft cloud of slow, large water droplets while the user builds a lather in her hands; and then triggers the third valve to shift flow to the second set of nozzles 162 for a fourth duration of time (e.g., 8 seconds) to enable the user to rinse soap from her hands; and then trigger the primary valve to close, thereby marking an end to this hand-washing cycle. In this example, if the user selects a button on the bathroom faucet to request high-volume flow (e.g., to fill a water bottle or to fill the sink), the controller can then trigger the primary and second valves to flow water through the unregulated fluid pathway, such as for a preset duration of time (e.g., 10 seconds).

In this foregoing variation, the controller can be further configured to interpret a hand gesture made by a user or motion of a user's hands near the bathroom faucet and can selectively index through the foregoing modes responsive to detected hand gestures and/or motion.

As a person skilled in the art will recognize from the previous detailed description and from the figures and claims, modifications and changes can be made to the embodiments of the invention without departing from the scope of this invention as defined in the following claims.

We claim:

1. A system comprising:

a mount comprising a proximal end defining an inlet configured to couple to a water supply;

a body defining a fluid circuit and coupled to the mount;

a pressure regulator:

interposed between the inlet and the fluid circuit; and configured to regulate a water supply at the inlet over a range of inlet pressures to a range of internal pressures in the fluid circuit, the range of internal pressures less than and narrower than the range of inlet pressures;

a set of nozzles:

arranged on the body;

coupled to the fluid circuit;

configured to, in response to the pressure regulator regulating water supplied at a first inlet pressure at the inlet down to a first internal pressure in the fluid circuit, discharge water droplets:

exiting the body with kinetic energies in a first range of kinetic energies; and in a first spray pattern extending from the body, defining a first width at a target distance below the body, and exhibiting a first volumetric ratio of water to air; and configured to, in response to the pressure regulator regulating water supplied at a second inlet pressure less than the first inlet pressure at the inlet down to a second internal pressure less than the first internal pressure in the fluid circuit, discharge water droplets:

exiting the body with kinetic energies in a second range of kinetic energies approximating the first range of kinetic energies; and in a second spray pattern extending from the body approximating the first spray pattern, defining a second width approximating the first width at the target distance below the body, and exhibiting a second volumetric ratio of water to air approximating the first volumetric ratio.

2. The system of claim 1:

wherein the range of inlet pressures comprises a range of inlet pressures between 20 pounds per square inch and 80 pounds per square inch;

wherein the range of internal pressures comprises a range of internal pressures approximately between 14 pounds per square inch and 20 pounds per square inch;

wherein the pressure regulator is configured to regulate a water supply at the inlet at the first inlet pressure of 80 pounds per square inch down to the first internal pressure of approximately 20 pounds per square inch in the fluid circuit; and wherein the pressure regulator is configured to regulate a water supply at the inlet at the second inlet pressure of 20 pounds per square inch down to the second internal pressure of approximately 14 pounds per square inch in the fluid circuit.

3. The system of claim 2:

wherein the set of nozzles is further configured to:

in response to the pressure regulator regulating water supplied at a third inlet pressure of 50 pounds per square inch at the inlet down to a third internal pressure of approximately 18 pounds per square inch in the fluid circuit, discharge water droplets:

exiting the body with kinetic energies in a third range of kinetic energies approximating the first range of kinetic energies; and in a third spray pattern extending from the body approximating the first spray pattern, defining a third width approximating the first width at the target distance below the body, and exhibiting a third volumetric ratio of water to air approximating the first volumetric ratio.

4. The system of claim 1:

wherein each nozzle in the set of nozzles comprises a full-cone nozzle; and wherein the set of nozzles is configured to discharge water droplets that converge into a cloud of water droplets at a spray angle proportional to internal pressure within the fluid circuit.

5. The system of claim 1:

wherein the set of nozzles:

comprises six nozzles arranged in a pattern, of maximum width less than eight inches, on the body; and are configured to discharge water droplets in conical sprays extending outwardly from the body and at conical angles proportional to internal pressure.

6. The system of claim 5, wherein the set of nozzles are arranged in the pattern defining a circular pattern of a radius less than four inches.

7. The system of claim 1:

wherein the pressure regulator is configured to regulate the inlet pressure down to the internal pressure to produce a droplet cloud discharged from the set of nozzles;

wherein the set of nozzles is configured to discharge water droplets forming a first droplet cloud exhibiting maximum width less than 20 inches at a distance of 18 inches from the body in response to the pressure regulator regulating water supplied at the first inlet pressure of 80 pounds per square inch at the inlet down to the first internal pressure in the fluid circuit; and wherein the set of nozzles is configured to discharge water droplets forming a second droplet cloud exhibiting minimum width greater than 16 inches at a distance of 18 inches from the body in response to the pressure regulator regulating water supplied at the second inlet pressure of 20 pounds per square inch at the inlet down to the second internal pressure in the fluid circuit.

8. The system of claim 1:

wherein the body and the set of nozzles define a showerhead; and wherein the mount is configured to mount to a shower drop ear and to support the showerhead laterally offset from a shower wall.

9. The system of claim 1, wherein the set of nozzles:

discharge water droplets predominately between 130 micrometers and 430 micrometers in width; and discharge water droplets at a flow rate between 1.0 gallon per minute and 1.75 gallons per minute over the range of inlet pressures.

10. The system of claim 1:

wherein the set of nozzles is configured to, in response to the pressure regulator regulating water supplied at the first inlet pressure at the inlet down to the first internal pressure in the fluid circuit, discharge water droplets:

exiting the body at a first exit velocity;

exhibiting a first average size;

exhibiting a first average hang time; and forming a first droplet cloud exhibiting a first thermal energy;

wherein the set of nozzles is configured to, in response to the pressure regulator regulating water supplied at the second inlet pressure at the inlet down to the second internal pressure in the fluid circuit, discharge water droplets:

exiting the body at a second exit velocity less than the first exit velocity;

exhibiting a second average size greater than the first average size; and exhibiting a second average hang time approximating the first average hang time; and forming a second droplet cloud exhibiting a second thermal energy approximating the first thermal energy.

11. The system of claim 10:

wherein the first droplet cloud exhibiting the first thermal energy comprises water droplets exhibiting a third thermal energy less than the first thermal energy;

wherein the second droplet cloud exhibiting the second thermal energy approximating the first thermal energy comprises water droplets exhibiting a fourth thermal energy greater than the third thermal energy.

12. The system of claim 1:

wherein the set of nozzles is configured to, in response to the pressure regulator regulating water supplied at the first inlet pressure at the inlet down to the first internal pressure in the fluid circuit, discharge water droplets exiting the body at a first flow rate of 1.35 gallons per minute; and wherein the set of nozzles is configured to, in response to the pressure regulator regulating water supplied at the second inlet pressure at the inlet down to the second internal pressure in the fluid circuit, discharge water droplets exiting the body at a second flow rate of 1.05 gallons per minute.

13. The system of claim 1:

wherein the set of nozzles is configured to discharge water droplets exiting the body with kinetic energies in the first range of kinetic energies between 0.118 microjoules and 2.40 microjoules, in response to the pressure regulator regulating water supplied at the first inlet pressure at the inlet down to the first internal pressure in the fluid circuit; and wherein the set of nozzles is configured to discharge water droplets exiting the body with kinetic energies in a second range of kinetic energies approximating the first range of kinetic energies, in response to the pressure regulator regulating water supplied at the second inlet pressure at the inlet down to the second internal pressure in the fluid circuit.

14. The system of claim 13, wherein the set of nozzles is configured to discharge water droplets exiting the body with kinetic energies over a range of kinetic energies comprising a particular kinetic energy of droplets associated with transition of human dermal sensation from gentle impact of water droplets to stinging impact of water droplets in response to the pressure regulator regulating water supplied within the range of inlet pressures down to an internal pressure within the range of internal pressures in the fluid circuit.

15. The system of claim 14:

wherein the pressure regulator and the set of nozzles cooperate to discharge droplets at a first flow rate in response to the pressure regulator regulating water supplied at the first inlet pressure down to the first internal pressure in the fluid circuit; and wherein the pressure regulator and the set of nozzles cooperate to discharge droplets at approximately the first flow rate and a third kinetic energy less than the first kinetic energy in response to a decrease of the first inlet pressure controlled via an external shower control.

16. The system of claim 1:

further comprising a set of flow restrictors arranged within the body and interposed between the pressure regulator and the set of nozzles;

wherein the pressure regulator and the set of flow restrictors cooperate to regulate water supplied at the first inlet pressure at the inlet down to a third internal pressure less than the first internal pressure in the fluid circuit;

wherein the pressure regulator, the set of flow restrictors, and the set of nozzles cooperate to discharge droplets at a first flow rate at the first inlet pressure; and wherein the set of nozzles is configured to, in response to the pressure regulator regulating water supplied at a second inlet pressure less than the first inlet pressure at the inlet down to a second internal pressure less than the first internal pressure in the fluid circuit, discharge water droplets at a second flow rate less than the first flow rate.

17. The system of claim 1, wherein the fluid circuit is arranged within the body and comprises:

a first inlet port adjacent a dorsal side of the body and configured to receive fluid under pressure;

a first set of entry transitions, each entry transition in the first set of entry transitions substantially coaxial with a nozzle in the set of nozzles and extending substantially vertically from an inlet of the nozzle toward the dorsal side of the body over a length greater than a minimum vertical flow length;

a manifold extending laterally from the first inlet port toward each entry transition in the first set of entry transitions substantially perpendicular to axes of the first set of entry transitions; and a first set of branches, each branch in the first set of branches extending laterally from the manifold over a length greater than a minimum entrance length and terminating at one entry transition in the first set of entry transitions.

18. The system of claim 1, further comprising a wand defining a second set of nozzles fluidly coupled to the pressure regulator.

19. A system comprising:

a mount comprising a proximal end defining an inlet configured to couple to a water supply;

a body defining a fluid circuit;

a set of nozzles arranged on the body and coupled to the fluid circuit;

a pressure regulator:

interposed between the inlet and the fluid circuit; and configured to regulate a water supply at the inlet over a range of inlet pressures to a range of internal pressures, the range of internal pressures less than and narrower than the range of inlet pressures;

wherein, in response to a supply of water at a first inlet pressure in the range of inlet pressures at the inlet:

the pressure regulator regulates the supply of water down to a first internal pressure in the range of internal pressures; and the set of nozzles discharges water droplets:

exiting the body at a first exit velocity;

exhibiting a first size range; and in a first spray pattern extending from the body, defining a first width at a target distance below the body, and exhibiting a first volumetric ratio of water to air;

wherein, in response to the supply of water at a second inlet pressure in the range of inlet pressures and less than the first inlet pressure at the inlet:

the pressure regulator regulates the supply of water down to a second internal pressure in the range of internal pressures;

the set of nozzles discharges water droplets:

exiting the body at a second exit velocity less than the first exit velocity;

exhibiting a second size range greater than the first size range; and in a second spray pattern extending from the body approximating the first spray pattern, defining a second width approximating the first width at the target distance below the body, and exhibiting a second volumetric ratio of water to air approximating the first volumetric ratio.

20. The system of claim 19:

wherein the set of nozzles are configured to, in response to the pressure regulator regulating water supplied at the first inlet pressure at the inlet down to the first internal pressure in the fluid circuit, discharge water droplets:

exiting the body with kinetic energies in a first range of kinetic energies;

exhibiting a first average hang time; and forming a first droplet cloud exhibiting a first thermal energy;

wherein the set of nozzles are configured to, in response to the pressure regulator regulating water supplied at the second inlet pressure at the inlet down to the second internal pressure in the fluid circuit, discharge water droplets:

exiting the body with kinetic energies in a second range of kinetic energies approximating the first range of kinetic energies; and exhibiting a second average hang time approximating the first average hang time; and forming a second droplet cloud exhibiting a second thermal energy approximating the first thermal energy.

* * * * *